United States Patent [19]

Müller

[11] Patent Number: 4,692,730

[45] Date of Patent: Sep. 8, 1987

[54] ELECTROMAGNETIC RELAY HAVING AN INSULATING CAP AND A METHOD FOR MANUFACTURING THE INSULATING CAP

[75] Inventor: Erwin Müller, Munich, Fed. Rep. of Germany

[73] Assignee: Siemens Aktiengesellschaft, Berlin and Munich, Fed. Rep. of Germany

[21] Appl. No.: 827,502

[22] Filed: Feb. 10, 1986

[30] Foreign Application Priority Data

Feb. 22, 1985 [DE] Fed. Rep. of Germany ..... 3506354

[51] Int. Cl.[4] ..... H01F 5/06

[52] U.S. Cl. ..... 335/278; 335/260; 336/198; 336/205

[58] Field of Search ..... 335/202, 260, 278–279, 335/282; 336/198, 205, 208

[56] References Cited

U.S. PATENT DOCUMENTS

| | | | |
|---|---|---|---|
| 2,058,037 | 10/1936 | Rigandi | 336/205 X |
| 3,043,994 | 7/1962 | Anderson et al. | 335/278 |
| 3,648,208 | 3/1972 | Rolf | 336/208 |
| 3,839,690 | 10/1974 | Kobler et al. | 335/278 |
| 4,480,243 | 10/1984 | Minks | 335/202 |
| 4,586,016 | 4/1986 | Rilley et al. | 336/205 X |

*Primary Examiner*—A. T. Grimley
*Assistant Examiner*—Jane K. Lau
*Attorney, Agent, or Firm*—Hill, Van Santen, Steadman & Simpson

[57] ABSTRACT

In a relay which has a coil body as a base body, an insulating cap of foil material is inverted over the wound coil body. The insulating cap is adapted to the outer contour of the wound coil and having a semi-cylindrical center section covering the upper half of the winding and pockets adapted to the coil body flanges. As a result thereof, the insulating cap is provided with good stability and is therefore protected against deformation and damage.

3 Claims, 4 Drawing Figures

ELECTROMAGNETIC RELAY HAVING AN INSULATING CAP AND A METHOD FOR MANUFACTURING THE INSULATING CAP

BACKGROUND OF THE INVENTION

1. Field of the Invention

The present invention relates to an electromagnetic relay comprising a base body carrying a winding, the axis of the base body being arranged parallel to a base plane, and comprising an insulating cap of foil material plugged over the winding, the insulating cap surrounding at least that part of the coil body and winding lying above a plane extending through the coil axis. The invention also relates to a method for manufacturing the insulating cap.

2. Description of the Prior Art

In a known relay, as disclosed in the German published application No. 22 58 479, corresponding to U.S. Pat. No. 3,839,690, fully incorporated herein by this reference, which comprises an insulation of foil material for the coil, the insulation is fashioned in the form of a tub having an essentially U-shaped cross section. The insulating tub lies between the yoke legs in a tub-shaped cut-out of a base body, whereby the outer contour of the insulating tub is largely adapted to the base body. After the coil, surrounded by the insulating tub, has been inserted, the insulating tub is practically no longer accessible from the exterior, so that it is also protected against damage. In order to achieve the greatest possible insulating paths in the region of the coil flanges, a pull-edge of the insulating tub engages into a peripheral groove of the coil flange. However, this requires that the coil flange be provided with a groove in adaptation to the insulating tub, i.e. be modified in shape.

SUMMARY OF THE INVENTION

The object of the present invention is to provide a relay of the type initially set forth which comprises an insulating cap, such that an optimum effect with optimum long insulating paths between the coil winding and the magnetic circuit portions located above the insulating cap is achieved, without modifying the base body, that, further, the insulating cap comprises a good shape stability despite small material thickness so that it is protected against mechanical damage or, respectively, deformation during assembly as well as during later handling of the relay and, therefore, is sure to retain its insulating effect. Furthermore, a method is to be provided in order to be able to manufacture the insulating caps for such relays and the most simple and most cost-effective manner possible, whereby, in particular, cutting the insulating cap free can occur with as simple as possible a cutting tool and in a single operation.

According to the present invention, the above object is achieved in that the insulating cap conforms tightly to the outer contour of the wound coil, whereby a center section covering the winding is fashioned semi-cylindrically and respective rectangular pockets for the coil body flanges are applied at both ends of the center section.

As a consequence of the matching of the insulating cap to the coil contour, according to the present invention, particularly to the coil flanges as well, the insulating cap receives a particularly good stability which is even further improved after being plugged onto the coil. The insulating cap is therefore prevented from being unintentionally damaged during the assembly of the yoke and the other magnetic circuit parts and, therefore, loosing its insulating effect. As a result of adaptation to the coil body, therefore, such damage can also be suppressed for later operation, even when no additional protection by a housing or a stable base body occurs.

It is further provided in accordance with a particular feature of the invention that the end faces of the insulating cap respectively comprise a recess or, respectively, a clearance for an axial coil core. The insulating cap can then be plugged onto the coil body immediately after the coil body has been wound without hindering the following assembly of the core.

According to another advantageous feature of the invention, the insulating cap also comprises an applied U-shaped section in the region below the plane extending through the coil axis, the U-shaped section having three walls perpendicular to the base plane. With this additional, U-shaped section, the insulating cap can additionally insulate terminal pins embedded in the coil body. In the region of its corners, the U-shaped section thereby advantageously comprises respective bulges projecting in the axial direction of the coil which surround the coil body shoulders provided with terminal pins and between which an extension of a yoke lies angularly over the coil.

A particularly advantageous method for manufacturing an insulating cap for a relay, in accordance with the present invention, wherein an insulating foil is deep-drawn in a form and the insulating cap is cut free from the coil is comprised such that a deep-drawn part encompassing the shape of the insulating cap is first fashioned in the foil, a foil edge departing roughly at right angles from the edge of the insulating cap being fashioned therein at all sides, whereby the cut edges between the edge of the insulating cap and the foil edge to be cut off extend partly parallel and partly oblique relative to the plane of the foil. Further, the insulating cap is cut free by a cutting tool working perpendicular to the foil plane. It is advantageous for the cut edges extending obliquely relative to the foil plane that they describe an angle of roughly 30° relative to the working direction of the cutting tool. In this manner, the insulating cap can be cut free from the foil in a single cut, even though the edge of the insulating cap does not circumferentially lie in a single plane. What is assured by the oblique guidance of the cut edges between the different planes of the cap edge is that the cutting tool, which is moved perpendicular to the foil plane, does not proceed in the direction of the edge, since this would lead to a crushing of the foil and would yield an irregularly cut cap edge.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
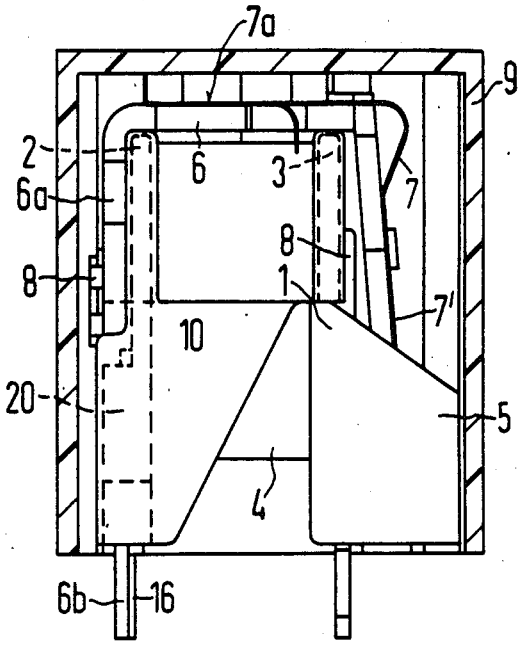
FIG. 1 is a side view of a relay constructed in accordance with the present invention, showing a housing in section.

The relay illustrated in FIG. 1 comprises a base body 1 fashioned as a coil body which carries a winding 4 between a pair of flanges 2 and 3. A contact pocket 5 in which the contact elements are secured in a known manner is also applied in a continuation of the coil flange 3. An angular yoke 6 overlies the coil body and an armature 7 is seated at one yoke edge, the armature 7 actuating a contact spring 7' secured thereto. The contact spring 7' extends beyond the armature seating and has a section **7*a* secured to the yoke and simultaneously serves as an armature retaining spring. A coil core 8 is axially plugged through the coil and is connected to the yoke leg 6*a* at one end. The relay is provided with a housing cap 9** which, for example, is composed of plastic.

Figure 2:
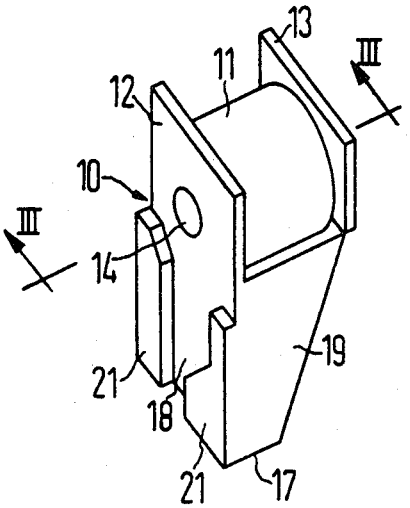
FIG. 2 is a perspective view of an insulating cap employed in the relay according to the present invention.
Figure 3:
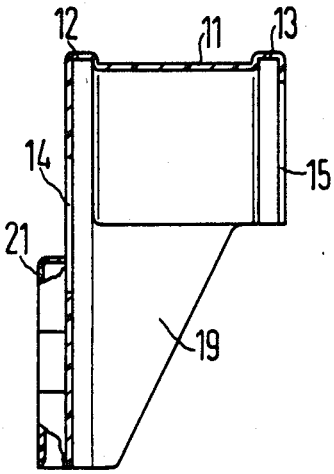
FIG. 3 is a sectional view taken along the line III—III of FIG. 2.

For the purpose of insulating between the coil winding and the magnetic circuit parts, i.e. particularly the yoke 6, an insulating cap 10 is inverted over the coil, the insulating cap 10 being shown in detail in FIGS. 2 and 3. In adaptation to the coil winding, the insulating cap comprises a semicylindrically formed center section 11 to which rectangularly-shaped pockets 12 and 13 are provided at both ends. The pockets 12 and 13 are adapted to the coil flanges 2 and 3 so that, when placed on the wound coil body, the insulating cap has its center portion lying on the upper half of the coil winding and has its pockets 12 and 13 lying on the coil flanges 2 and 3. Not only are long creep and air paths therefore created between the yoke 6 and the winding 4, but, rather, the insulating cap 10 also receives good stability which prevents a deformation or a tearing of the insulating cap of thin foil material both during manufacture and assembly and during later use (for instance, given use without a housing). For the purpose of plugging the core, the insulating cap comprises an annular opening 14 in the pocket 12 and a recess 15 opening to an edge in the pocket 13.

In order to also effectively insulate the yoke leg **6*a* from the coil terminal pin 16, the yoke leg 6*a* lying on the coil flange 2 and comprising an extension 6*b*, the insulating cap comprises a U-shaped section 17 in continuation of the pocket 12, the U-shaped section 17 having three walls perpendicular to the base plane, in particular, a middle wall 18 and two side walls 19 which also surround the lower portion of the coil from one side. Since shoulders 20 for receiving the coil terminal pin 16 are applied to the base body, bulges 21 projecting in the axial direction are formed in the U-shaped section of the insulating cap, the bulges 21 surrounding the coil body shoulders. A wall portion of the middle wall 18 lying in one plane with the outside of the pocket 12 remains between the bulges 21, the continuation of the coil body leg 6*a* comprising the terminal pin 6*b*** lying on this wall portion.

The insulating tub 10 is advantageously manufactured from an insulating foil by a vacuum drawing process. The drawing is also advantageously in a pallet-shaped multiple arrangement, whereby the individual insulating caps are subsequently punched at structurally-provided cutting bevels.

Figure 4:
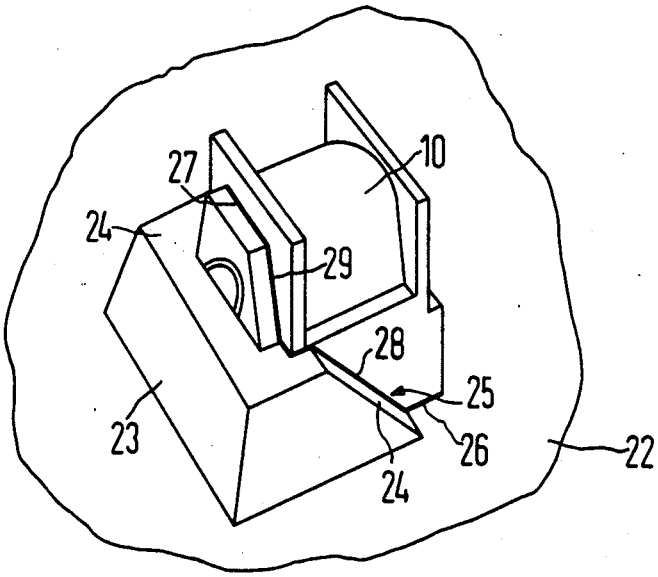
FIG. 4 is a perspective view of the deep-drawn part encompassing the insulating cap.

FIG. 4 is a perspective view of the deep drawn part 23 produced from a planar foil 22 by a deep drawing process, for example, by a vacuum drawing process, the deep drawn part 23 including the insulating cap 10. Since the insulating cap 10 does not comprise a circumferential edge in the plane of the foil 22, the deep-drawn part 23 is shaped such that the insulating cap 10 can be cut free with a single cut with a cutting tool working perpendicular to the plane of the foil 22. In those regions in which the edge of the insulating cap does not lie in the plane of the foil, therefore, a foil edge 24, projecting at roughly a right angle from the insulating cap, is fashioned with a deep-drawn part 23, the foil edge 24 being cut off at a cut edge 25 when the insulating cap 10 is cut free. In the case of the parts of the cut edge 25 which lie in the plane of the foil 22 or parallel thereto, those, for example, are the section 26 and 27, the cutting tools strikes the edge perpendicularly and can therefore cut without problems. In the transition regions, for example the sections 28 and 29, between the parallel sections, the deep-drawn portion has been shaped such that the cut edge in these regions extends obliquely relative to the foil plane and, therefore, obliquely to the working direction of the cutting tool, for example at an angle of 30° . It is therefore assured that the cutting tool does not strike the foil in the running direction of the cut edge, since this would lead to a crushing of the foil and, therefore, to an irregular cutting of the cap edge. With the shaping of the deep-drawn part 23 as shown, therefore, the insulating cap 10 can be separated from the foil in a single operation of the cutting tool, whereby a smooth cut occurs at the overall edge of the insulating cap.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In an electromagnetic relay of the type in which a coil body carrying a winding having an axis, in which the coil body comprises end flanges perpendicular to the axis, and in which an insulating cap surrounds at least that portion of the coil body and winding lying above a plane extending through the axis, the improvement comprising:

a central section of the insulating cap shaped complementary to the outer contour of and receiving the winding therein;

a pair of pockets perpendicular to the axis and connected to said central section and receiving respective ones of the flanges;

a yoke including a first leg extending parallel to the axis adjacent and external of the insulating cap and a second leg extending perpendicular to the axis adjacent one of the pockets and external of the insulating cap; and an axially extending core projecting out of each end of the coil body, the insulating cap comprising means defining clearances for receiving the projecting ends of the core.

2. The improved electromagnetic relay of claim 1, wherein:

said insulating cap further comprises, below the plane of its axis, a section connected to and depending from said central section and including first and second parallel spaced walls defining a U-shaped structure with said central section, and a third wall between said first and second walls, said walls extending perpendicular to the plane through the axis.

3. The improved electromagnetic relay of claim 2, wherein the relay further comprises:

shoulders extending from one of the flanges;

terminal pins extending downwardly from the coil body in respective ones of the shoulders;

a yoke extension extending from said second leg and lying between said shoulders; and means carried by said third wall and defining recesses for receiving said shoulders.

* * * * *